US005172460A

United States Patent [19]

Womack

[11] Patent Number: 5,172,460

[45] Date of Patent: Dec. 22, 1992

[54] METHOD OF MAKING LEAD-FREE CAPSULE FOR WINE BOTTLES

[75] Inventor: Thomas H. Womack, Novato, Calif.

[73] Assignee: Womack International, Inc., Novato, Calif.

[21] Appl. No.: 748,242

[22] Filed: Aug. 21, 1991

[51] Int. Cl.[5] ..... B21D 33/00

[52] U.S. Cl. ..... 29/17.3; 29/17.2; 29/469.5; 72/347; 215/251

[58] Field of Search ..... 29/17.1, 17.2, 17.3, 29/33 Q, 33 S, 469.5; 72/51, 347; 215/251, 72, 29

[56] References Cited

U.S. PATENT DOCUMENTS 1,956,818 5/1934 Acre ..... 29/17.3 X
2,018,725 10/1935 Johnson et al. ..... 29/17.3 X
2,813,332 11/1957 Keay, Jr. ..... 29/17.3 X

FOREIGN PATENT DOCUMENTS 117834 9/1981 Japan ..... 29/17.3

*Primary Examiner*—Timothy V. Eley
*Attorney, Agent, or Firm*—John A. Bucher

[57] ABSTRACT

A lead-free capsule for wine bottles and the like and a method for producing the capsule to have similar characteristics as traditional lead and lead-tin capsules include the selection of a laminate of metallic foil and plastic sheet having a soft metallic surface look and feel, the laminate having characteristics of flexibility, ductility and adhesion permitting the laminate to be drawn to form a continuous, seamless capsule configuration while maintaining laminate integrity.

8 Claims, 1 Drawing Sheet

METHOD OF MAKING LEAD-FREE CAPSULE FOR WINE BOTTLES

FIELD OF THE INVENTION

The present invention relates to a capsule or secondary closure for wine bottles and the like and a method for producing the capsule and more particularly to such a product and method where the capsule is lead-free.

BACKGROUND OF THE INVENTION

Wine bottles have long been provided with capsules or secondary closures forming a decorative closure or covering for the open neck of the bottle. The neck of the wine bottle is of course sealed by a cork. Thus, the capsule does not actually serve as a closure except to prevent exposure of a portion of the cork.

However, based on longstanding tradition, the capsule is considered an important part of the wine bottle, especially in providing a decorative closure. Thus, at least for premium wines, the capsule and label are considered important decorative elements of the bottle.

Originally, capsules for wine bottles were formed from lead which was generally desirable because of its ductility and malleability, permitting the capsule to be readily formed on the wine bottle and to accept suitable decoration. The pure lead capsules were eventually replaced by capsules formed from a combination of lead and tin. However, the lead-tin capsules had generally similar characteristics as the lead capsules. These characteristics which are summarized below have become traditionally accepted and it is believed important to maintain these characteristics, particularly for premium wines as noted above.

Both the traditional lead and lead-tin capsules had a soft, lustrous appearance because of their metal composition. In addition, both types of capsules had characteristics of flexibility and ductility enabling them to be readily formed as secondary closures on wine bottles.

Characteristics of the capsule during its removal from the wine bottle are of equal importance, at least in conveying the same "feel" as the traditional lead and lead-tin capsules. In this regard, it has become common practice to either cut and/or tear the capsule in order to expose the open end of the bottle neck for permitting removal of the cork. Accordingly, it is also believed necessary to maintain the characteristics of cuttability and tearability similar to the traditional lead and lead-tin capsules.

Recently, there has been a movement to eliminate lead as a packaging component for environmental reasons. In connection with wine bottles, the use of lead may be environmentally objectionable both because of its possible contact with a beverage contemplated for human consumption and, of possibly greater importance, to avoid disposal problems for lead components, for example, in landfill and the like.

It has thus become desirable to avoid the use of lead in wine bottle capsules. More recently, capsules have been formed from tin since it is a generally flexible and ductile metal having generally similar characteristics as those discussed above for the traditional lead and lead-tin capsules. Tin has also been a logical choice as a substitute for lead because of its similar metallic characteristics permitting flat blanks to be subjected to relatively deep drawing techniques for forming the capsule. However, since the sources of tin are relatively limited and remote, the market for tin is relatively volatile.

Accordingly, problems may develop in the use of tin because of unavailability and/or cost.

Capsules for wine bottles have also been formed from laminates of plastics and metal foils. However, because of the different processing characteristics for these laminates compared with metals such as lead or lead-tin, wine bottle capsules have been manufactured by different techniques when using the laminates. The most common configuration is the simple formation of a cylinder from the laminate with one end being crimped to form an annular flange upon which a cover is joined or cemented in order to form the same capsule-like closure for wine bottles. These capsules have generally experienced less acceptance in the market particularly because they differ from the traditional appearance and characteristics of the standard lead and lead-tin capsules. In particular, with the cylinder being formed from a flat sheet of laminate, the capsule has a visible side seam. In addition, the crimping of the closed end of the cylinder and cementing of a cover thereon also provides an obvious difference from the traditional capsules.

Thus, there remains a need for wine bottle capsules capable of overcoming problems of the type noted above while exhibiting similar characteristics as the traditional wine bottle capsules.

SUMMARY OF THE INVENTION

More specifically, there has been found to remain a need for capsules for wine bottles and the like, the capsules being formed from lead-free materials while retaining the same soft, lustrous appearance and physical characteristics as traditional lead and lead-tin capsules.

It is accordingly an object of the present invention to provide such an improved capsule and method for forming the capsule. More particularly, it is an object of the invention to provide a capsule and method of forming the capsule from a material providing desired characteristics similar to traditional capsules while being lead-free and at the same time being suitable for processing by relatively deep drawing processes to form the capsule in a continuous and seamless configuration.

In this regard, it has been found that a capsule can be formed from a lead-free trilaminate of metal foil-plastic-metal foil or a bilaminate of metal foil-plastic having characteristics of flexibility, ductility and adhesion permitting flat blanks of the laminate to be deep drawn into the capsule configuration. Preferably, the invention contemplates drawing of the laminate into the capsule configuration in multiple steps in order to better assure formation of a continuous, seamless capsule configuration while maintaining laminate integrity.

It is a further object of the invention to provide such a lead-free capsule and method of formation or manufacture wherein the laminate preferably has an overall thickness of about 3–6 mils, more preferably about 6 mils but also possible as little as 2 mils. The term "mil" is used herein to indicate a thickness of 1/1,000 inch. It is further preferred that the laminate be formed from a plastic sheet of at least about 1–2 mils thickness and one or two metallic foils each of less than about 2 mils thickness. A still further preferred configuration includes a plastic sheet having a thickness of generally about 5 mils with the metallic foil sheet or sheets having a thickness of about ½ mil in order to achieve greater flexibility and a more desirable soft metallic feel in the resulting capsule while maintaining desirable characteristics of cuttability, tearability and ductility in the laminate for achieving desired look and feel and removal characteristics.

The metallic foil sheets are formed from a ductile metal preferably selected from the class consisting of tin and aluminum alloys or combinations thereof or similar ductile metals. Aluminum is readily available and relatively inexpensive. Although tin is relatively scarce and available only from remote sources, its use in a laminate of the type contemplated by the present invention is particularly desirable because substantially less tin is required in the foil sheet or sheets for the laminate.

The plastic sheet is intimately bonded to the foil sheet or sheets to resist separation therefrom. At the same time, the plastic sheet contributes substantially to the characteristics of cuttability and tearability in the resulting capsule for achieving similar characteristics as the traditional lead and lead-tin capsules. It has also been surprisingly found according to the present invention that a laminate of metallic foil and plastic can be formed by relatively deep drawing techniques in order to result in the relatively smooth, seamless capsule configuration similar to that of traditional capsules as described above. At the same time, adhesion between the plastic sheet and the metallic foil sheet or sheets is important in order to maintain laminate integrity in the finished capsule as noted above.

Additional objects and advantages of the invention are made apparent in the following description having reference to the accompanying apparent in the following description having reference to the accompanying drawings.

BRIEF DESCRIPTION OF THE DRAWINGS

FIG. 3 also schematically represents a drawing device of a type suitable for converting the flat blank of FIG. 1 to the configuration of FIG. 2.

DESCRIPTION OF THE PREFERRED EMBODIMENT

A lead-free wine bottle capsule and method of manufacturing the capsule are disclosed below. In accordance with the present invention it has been surprisingly found possible to form a lead-free capsule from a laminate of metallic foil-plastic sheet-metallic foil or metallic foil-plastic sheet, the laminate being capable of deep drawing, preferably in multiple steps, to produce a continuous, seamless capsule configuration while maintaining laminate integrity, the capsule otherwise having visual, textural and compositional characteristics closely resembling the look and feel of traditional lead and lead-tin capsules while also maintaining characteristics of cuttability and tearability closely resembling removal characteristics of traditional lead and lead-tin capsules.

Thus, while avoiding the use of lead in accordance with various environmental purposes, it has been found possible to produce a wine bottle capsule having generally the same characteristics as the traditional capsules while also being of a continuous and seamless configuration. All of these characteristics are important in order to provide a wine bottle capsule resembling traditional capsules and, in particular, achieving generally similar aesthetic characteristics as the traditional capsules.

Figure 1:
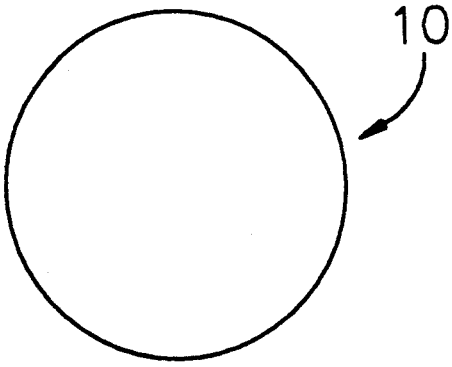
FIG. 1 is a representation of a flat blank formed according to the present invention from a metallic foil-plastic-metallic foil laminate.
Figure 2:
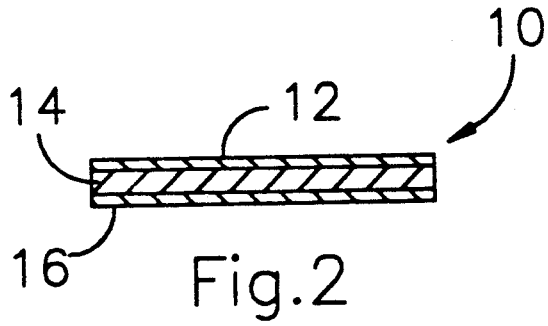
FIG. 2 is a sectional view of the laminate of FIG. 1 to illustrate its preferred formation from metallic foil-plastic sheet-metallic foil.

Referring now to the drawings and particularly to FIGS. 1 and 2, it has been found possible according to the present invention to form a continuous, seamless capsule for wine bottles and the like from a laminate generally indicated at 10 in FIGS. 1 and 2.

Referring particularly to FIG. 2, the laminate 10 is formed with alternate layers of metallic foil 12, plastic sheet 14 and metallic foil 16. The layers are preferably arranged as metallic foil-plastic sheet-metallic foil in order to provide a metallic surface texture and appearance on both sides of the laminate and also to accommodate the drawing qualities required in the laminate material. The metallic foil layers and the plastic sheet 14 are further selected in accordance with the following description to closely resemble other characteristics of traditional wine bottle capsules formed from lead and lead-tin.

The laminate 10 preferably has an overall thickness of about 3–6 mils but may have a thickness as low as 2 mils while more preferably having a thickness of about 6 mils corresponding to the thickness of the traditional capsules. Broadly, the laminate includes the plastic sheet 14 having a thickness of at least about 1–2 mils with each of the metallic foils 12 and 16 having a thickness of less than about 2 mils. Preferably, the plastic sheet 14 has a thickness of at least about 4 mils with each of the metallic foils having a thickness of no more than about 1 mil. Even more preferably, the laminate 10 is formed with the plastic sheet 14 having a thickness of up to about 5 mils with each of the metallic foils 12 and 16 having a thickness of about ½ mil in order to achieve greater flexibility and a more desirable soft metallic feel while maintaining other desirable characteristics of cuttability, tearability and ductility in the laminate for achieving desired look and feel and removal characteristics. At the same time, it is again emphasized that adhesion within the laminate is essential in order to permit deep drawing of the laminate to form the capsule configuration while maintaining laminate integrity.

The metallic foils 12 and 16 may be formed from a variety of metals or metal-like materials including alloys and mixtures of different metals. Preferably, the metallic foils 12 and 16 are formed from metals selected from the class consisting of aluminum and tin as well as alloys and mixtures thereof and other similar ductile metals. The selection of the metal is of course important to maintain the desired characteristics of flexibility and ductility as well as the surface appearance and texture for the laminate. Depending upon the metal selected for use in the foils 12 and 16, the thickness of the foils may also be selected for further optimizing those characteristics. Generally, it is contemplated according to the present invention that such characteristics can best be achieved with the metallic foils having a thickness of no more than about ½ mil.

The plastic sheet 14 may be formed from a variety of plastics which are known to be capable of good adhesion within a laminate structure and which are also capable of being cut or torn in accordance with the objectives of the present invention. The sheet is preferably a thermoplastic film of propylene or ethylene or similar materials and more preferably includes a bonding agent such as acrylic acid. Such films are commercially available. The acrylic acid promotes adhesion of the plastic to other lamina such as metal foil. It would of course also be possible to use other plastics such as polyethylene tetrafluoride (PET), polyurethane, polystyrene, etc. as long as the desirable characteristics discussed above are maintained. It would be possible to precoat or prime the foil with a suitable coating or primer which would have advantageous adhesion qualities.

As noted above, it is particularly important to select the materials and thicknesses in the laminate 10, not only to provide the surface appearance and texture on the laminate, but also to permit the laminate to be drawn relatively deeply in order to form the capsule configuration. At the same time, it is necessary to provide adequate adhesion and other characteristics within the laminate so that laminate integrity is maintained in the final capsule configuration. In this regard, the term "laminate integrity" is defined to mean that the metallic foil layers 12 and 16 (or a single foil layer) remain closely adhered to the plastic sheet 14 and that all layers of the laminate remain continuous throughout the capsule configuration.

Figure 6:
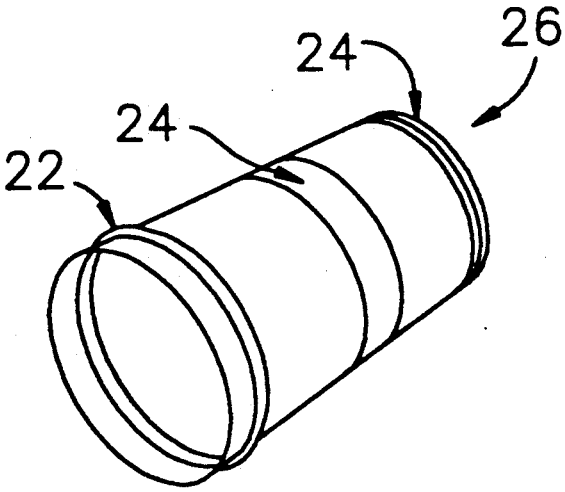
FIG. 6 is a generally pictorial view of a capsule similar to that of FIG. 4 while being subjected to further embossing and surface treatment to provide decorative features conventionally employed upon such capsules.

The laminate 10 is drawn into a capsule configuration as best illustrated in FIG. 6 by multiple drawing steps described in greater detail below.

Figure 3:
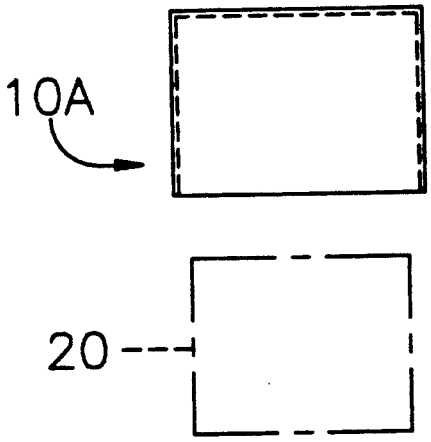
FIG. 3 represents an intermediate configuration resulting from subjecting the flat blank of FIG. 1 to a first drawing step.

Initially, referring to FIG. 3, the flat laminate blank 10 of FIG. 1 is initially drawn to an intermediate configuration 10A in a generally conventional drawing technique employing opposed members generally illustrated in phantom at 18 and 20. The characteristics of the drawing process are selected in accordance with standard drawing technology. Generally, it is contemplated that dimensional changes effected in each drawing step not exceed a ratio of about 1:1.

Figure 4:
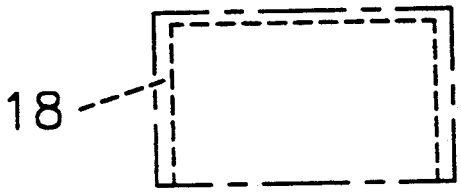
FIG. 4 illustrates a deep drawn configuration for a capsule resulting from at least a second drawing step.
Figure 4:
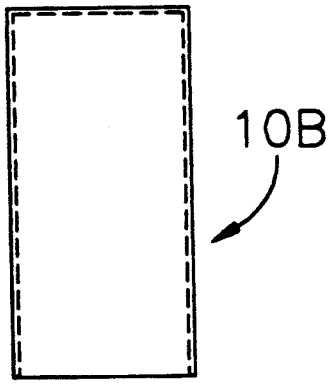

Thereafter, the intermediate capsule configuration 10A may be further drawn in one or more additional drawing steps to form a fully drawn capsule configuration 10B as illustrated in FIG. 4. The drawing step or steps carried out to achieve the capsule configuration 10B are generally similar as described above for FIG. 3 except for the increased dimensional changes in the capsule 10B.

Figure 5:
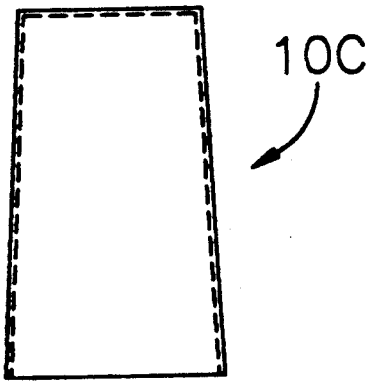
FIG. 5 represents yet another view of the capsule wherein the sides are generally tapered in either a second or subsequent drawing step to form a traditional capsule configuration.

A further drawn configuration for the capsule is illustrated at 10C in FIG. 5 wherein it is noted that the capsule is provided with a tapered configuration along its length.

Finally, the capsule 10C is subjected to further surface treatments in order to form embossing and decorations upon its surface according to the specific user. Referring to FIG. 6, such surface treatment may include embossing 22 and surface decoration 24. Otherwise, a finished capsule is generally illustrated at 26 in FIG. 6 to be of generally continuous and seamless construction. Because of the use of the laminate 10, the finished capsule 26 has metallic surface characteristics both in terms of appearance and texture. At the same time, the combination of the metallic foil layers and plastic sheet in the laminate permit the laminate to be drawn into the configuration of the finished capsule 26 with the desired characteristics of continuity and seamlessness while maintaining laminate integrity.

The preceding steps for forming the capsule are generally exemplary of steps to be employed for forming the finished capsule 26. However, it is to be noted that a capsule could be formed according to the present invention without all of the specific manufacturing steps described with reference to FIGS. 3–5. For example, the capsule could be formed with a reduced number of drawing steps. However, it is particularly contemplated that multiple drawing steps are required in order to achieve the finished capsule configuration of the present invention.

Accordingly, there has been described a lead-free capsule for use on wine bottles and the like and a method for manufacturing the capsule. Various modifications are possible within the scope of the present invention as described above. Accordingly, the scope of the present invention is defined only by the following claims which are further exemplary of the invention.

What is claimed is:

1. A method of forming a moldable, flexible capsule for wine bottles, comprising the steps of selecting a laminate of lead-free metallic foil and plastic having a soft metallic surface look and feel, the laminate having characteristics of flexibility, ductility and laminal adhesion permitting relatively deep drawing, drawing the laminate from a generally flat blank to form a continuous, seamless capsule configuration while maintaining laminate integrity, and applying surface treatment for decorating the capsule prior to applying it to the wine bottle, whereby the use of lead is avoided for environmental purposes while still achieving the soft, metallic look and feel of traditional lead and lead-tin capsules as well as cuttability and tearability resembling removal characteristics of the traditional lead and lead-tin capsules.

2. The method of claim 1 wherein the laminate is formed from a plastic sheet of at least about 1–2 mils thickness and metallic foil of less than about 2 mils thickness to form the laminate thickness.

3. The method of claim 2 wherein the laminate is formed from about 2–4 mil thickness plastic sheet and about ½–1 mil thickness metallic foil.

4. The method of claim 3 wherein the laminate has a metallic foil-plastic-metallic foil configuration to achieve greater flexibility and a more desirable soft metallic feel while maintaining desirable characteristics of cuttability, tearability and ductility in the laminate for achieving desired look and feel and removal characteristics.

5. The method of claim 1 wherein the metallic foil is formed from a metal selected from the group consisting of tin and aluminum.

6. The method of claim 1 wherein the metallic foil is formed from aluminum.

7. The method of claim 6 wherein the laminate is formed from about 2–4 mil thickness plastic sheet and about ½–1 mil thickness metallic foil.

8. The method of claim 7 wherein the laminate has a metallic foil-plastic-metallic foil configuration to achieve greater flexibility and a more desirable soft metallic feel while maintaining desirable characteristics of cuttability, tearability and ductility in the laminate for achieving desired look and feel and removal characteristics.

* * * * *